US007735665B2

(12) United States Patent
Robinson

(10) Patent No.: US 7,735,665 B2
(45) Date of Patent: Jun. 15, 2010

(54) CHILD-RESISTANT FLIP-TOP DISPENSING CLOSURE, PACKAGE AND METHOD OF MANUFACTURE

(75) Inventor: Philip J. Robinson, Sylvania, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 1519 days.

(21) Appl. No.: 11/062,177

(22) Filed: Feb. 18, 2005

(65) Prior Publication Data

US 2006/0186077 A1 Aug. 24, 2006

(51) Int. Cl.
*B65D 43/16* (2006.01)
*B65D 47/08* (2006.01)

(52) U.S. Cl. ..... 215/237; 220/326; 220/835; 222/556

(58) Field of Classification Search ..... 215/216, 215/235, 237, 253, 330; 222/556
See application file for complete search history.

(56) References Cited

U.S. PATENT DOCUMENTS 3,902,628 A * 9/1975 Schurman ..... 220/835
4,170,315 A * 10/1979 Dubach et al. ..... 220/281
4,429,800 A * 2/1984 Greenspan ..... 215/216
5,137,260 A * 8/1992 Pehr ..... 215/216
5,579,957 A * 12/1996 Gentile et al. ..... 222/153.14
6,170,683 B1 1/2001 Montgomery
6,325,252 B1 * 12/2001 Brozell et al. ..... 222/212
6,405,885 B1 6/2002 Elliott
6,409,034 B2 * 6/2002 Schorner ..... 215/237
6,484,895 B2 * 11/2002 Montgomery et al. ..... 215/237
7,404,495 B2 * 7/2008 Keung ..... 215/237

FOREIGN PATENT DOCUMENTS

EP 1357049 A2 10/2003
EP 1502871 A2 2/2005

OTHER PUBLICATIONS

Application (22pgs) w/Drawings FIGS. 1-9 U.S. Appl. No. 10/628,521, filed Jul. 28, 2003.

* cited by examiner

*Primary Examiner*—Anthony Stashick
*Assistant Examiner*—James N Smalley
(74) *Attorney, Agent, or Firm*—Reising Ethington PC

(57) ABSTRACT

A child-resistant dispensing closure includes a base having a deck with a dispensing opening, a peripheral skirt extending from the deck, and an inner wall extending from the deck for securing the closure to a container. An axial passage extends from the deck between the peripheral skirt and the inner wall, and opens radially outwardly through the peripheral skirt. A pair of spaced ledges are disposed in the axial passage. A lid is molded integrally with the base and is coupled by a hinge to the base so as to be pivotable between a closed position overlying the deck and an open position spaced from the deck. The lid has a latch arm that resiliently extends from a periphery of the lid. The latch arm has a pair of oppositely extending tabs for engagement with the ledges to lock the lid in the closed position. The latch arm is directly manually engageable by a user from a radial direction external to the closure to pivot the latch arm radially inwardly within the passage and release the tabs from the ledges so that the lid can be pivoted toward the open position drawing the latch arm out of the axial passage.

17 Claims, 6 Drawing Sheets

CHILD-RESISTANT FLIP-TOP DISPENSING CLOSURE, PACKAGE AND METHOD OF MANUFACTURE

The present disclosure is directed to hinged flip-top dispensing closures and packages, and more particularly to provision of a child-resistance feature on such a closure and package.

BACKGROUND AND SUMMARY OF THE INVENTION

U.S. Pat. Nos. 4,638,916 and 5,489,035 disclose dispensing closures of one-piece integrally molded plastic construction. These closures include a base with a dispensing opening and an internally threaded skirt for securement to a container neck finish. A lid is integrally connected by a hinge to a periphery of the base. Copending application Ser. No. 10/628,521 discloses a child-resistant dispensing closure that includes a base having a deck with a dispensing opening and a peripheral skirt. A lid is integrally molded with the base and coupled by a hinge to a periphery of the base so as to be pivotable between closed and open positions. One of the lid and the base has a latch arm resiliently extending from its periphery diametrically opposite the hinge. The latch arm has a pair of oppositely extending tabs adjacent to a free end of the arm. The other of the base and the lid has an axial passage for receiving the latch arm, and a pair of laterally spaced ledges in the passage for engagement by the tabs to lock the lid in a closed position. The latch arm is directly manually engageable by a user from a radial direction external to the closure to pivot the latch arm radially inwardly within the passage and release the tabs from the ledges so that the lid can be pivoted to the open position.

The present disclosure embodies a number of aspects or inventions that may be implemented separately from or in combination with each other.

A child-resistant dispensing closure in accordance with one aspect of the present disclosure includes a base having a deck with a dispensing opening, a peripheral skirt extending from the deck, and an inner wall extending from the deck for securing the closure to a container. An axial passage extends from the deck between the peripheral skirt and the inner wall, and opens radially outwardly through the peripheral skirt. A pair of spaced ledges are disposed in the axial passage. A lid is molded integrally with the base and is coupled by a hinge to the base so as to be pivotable between a closed position overlying the deck and an open position spaced from the deck. The lid has a latch arm that resiliently extends from a periphery of the lid. The latch arm has a pair of oppositely extending tabs for engagement with the ledges to lock the lid in the closed position. The latch arm is directly manually engageable by a user from a radial direction external to the closure to pivot the latch arm radially inwardly within the passage and release the tabs from the ledges so that the lid can be pivoted toward the open position drawing the latch arm out of the axial passage. The base preferably has a fulcrum on the deck adjacent to the axial passage for engagement by the latch arm to increase the resistance of the latch arm to bending within the axial passage. The tabs preferably have inside surfaces aligned with an outside surface of the lid adjacent to the latch arm to facilitate demolding of the closure.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
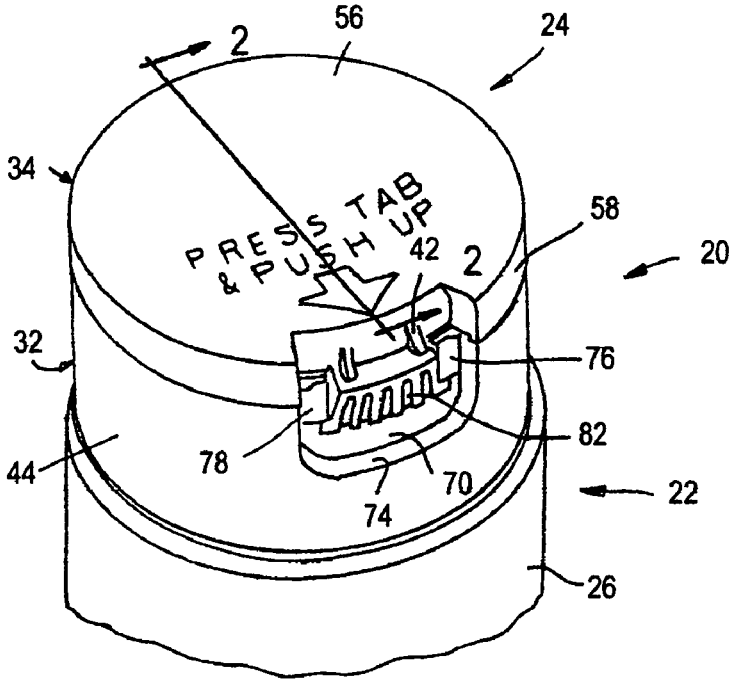
FIG. 1 is a fragmentary perspective view of a child-resistant package in accordance with one presently preferred embodiment of the disclosure.

The disclosure of U.S. application Ser. No. 10/628,521 is incorporated herein by reference.

FIGS. 1-7 illustrate a child-resistant package 20 in accordance with one presently preferred embodiment of the disclosure as including a container 22 and a dispensing closure 24 secured to the container. Container 22 has a body 26 of flexible resilient construction, preferably molded plastic construction, that can be squeezed by a user to dispense product from within the container through closure 24. Container 24 also has a neck finish 28, preferably cylindrical in contour, having one or more external thread segments or external beads 30 to which closure 24 is secured.

Closure 24 includes a base 32 and a lid 34 integrally coupled to base 32 by a pivot hinge 36. Hinge 36 may be of any suitable type, such as that illustrated in U.S. Pat. No. 6,041,477 or those illustrated in above-noted U.S. Pat. No. 4,638,916 or 5,489,035. Closure base 32 includes a deck 38, which may be flat as shown or domed, slanted or of other suitable contour. A dispensing opening 40 is provided in deck 38, and may be surrounded by a wall 42 that extends axially from deck 38. Opening 40 and wall 42 may be diamond-shaped as illustrated in the drawings, or may be circular or of any other suitable geometry. A dispensing valve or the like could be disposed within opening 40, and the dispensing opening can be concentric with or offset from the axis of the closure. A skirt 44 extends from the outer periphery of deck 38. Peripheral skirt 44 is cylindrical in the embodiment illustrated in the drawings. However, skirt 44 may be of other suitable geometry, such as oval, for matching the geometry of container body 26.

An inner wall 46 extends from deck 38 within skirt 44, preferably concentrically with skirt 44. Inner wall 46 preferably is cylindrical and has one or more internal threads or beads 48 for engagement with external threads or beads 30 on container neck finish 28 to secure the closure to the container. Although threaded or snap-bead securement is preferred, the closure could be secured to the container by bonding or other suitable means. At least one tab 50 (FIGS. 4 and 10) preferably axially extends from inner wall 46, more preferably a pair of diametrically opposed tabs as illustrated. In assembly of closure 24 with container 22, tabs 50 are received within diametrically opposed pairs of lugs 52 on container neck finish 28. Lugs 52 are contoured so that tabs 50 can ride over and snap between the lugs during application of the closure to the container neck finish, but resist removal of the closure from the container after such assembly. In the illustrated exemplary embodiment of the disclosure, an annular wall 54 extends from deck 38 within inner wall 46 and is received in plug-sealing engagement with the open end of container neck finish 28.

Figure 2:
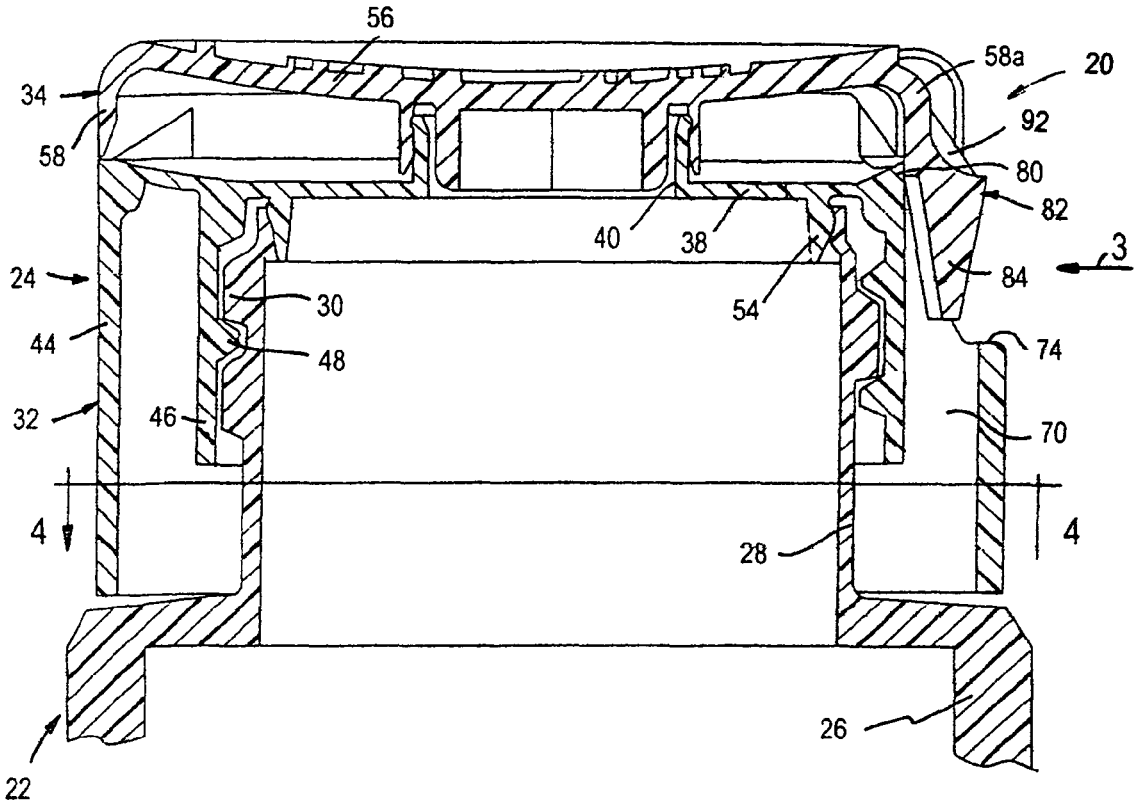
FIG. 2 is a fragmentary sectional view taken substantially along the line 2-2 in FIG. 1.
Figure 3:
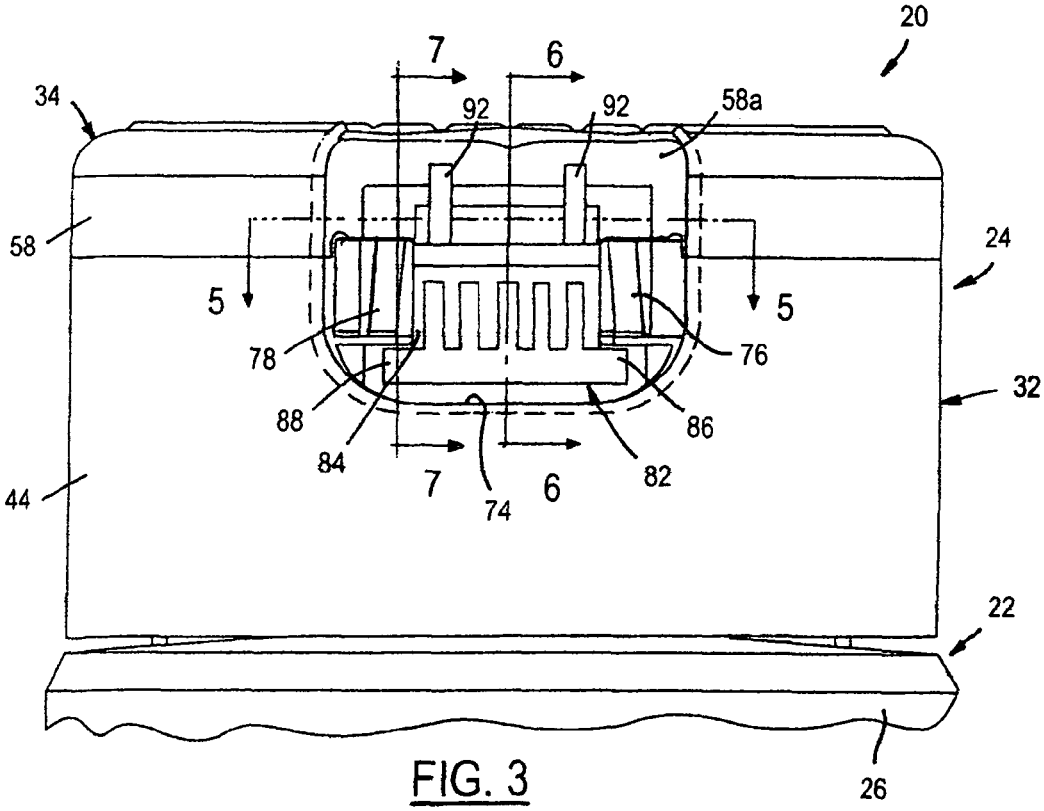
FIG. 3 is a fragmentary plan view taken from the direction 3 in FIG. 2.
Figure 4:
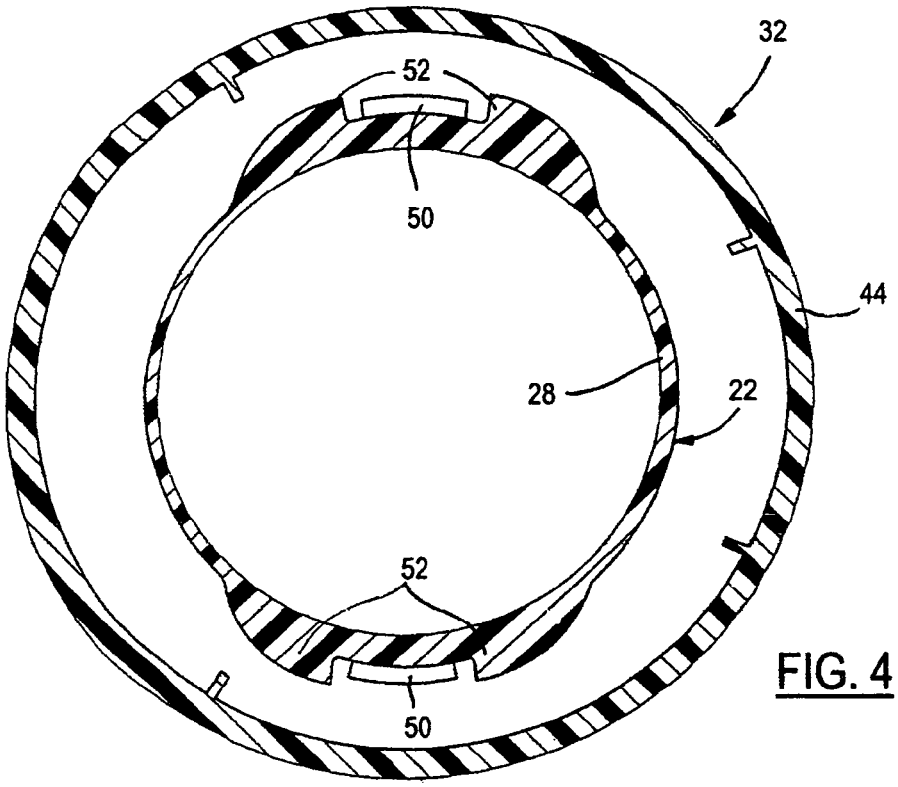
FIG. 4 is a sectional view taken substantially along the line 44 in FIG. 2.
Figure 5:
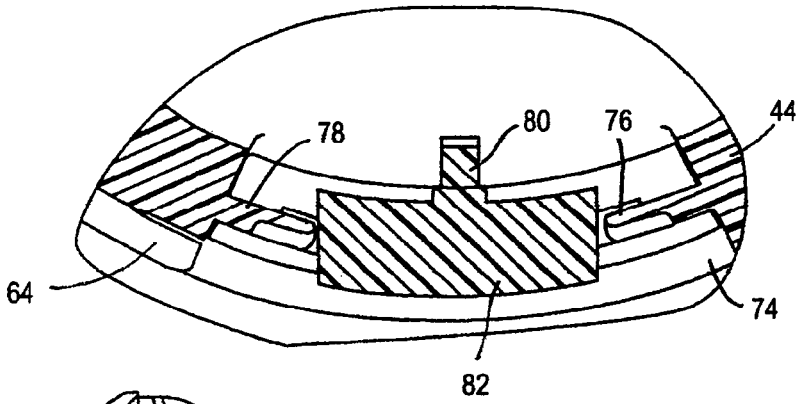
FIGS. 5, 6 and 7 are fragmentary sectional views taken substantially along the respective lines 5-5, 6-6 and 7-7 in FIG. 3.
Figure 6:
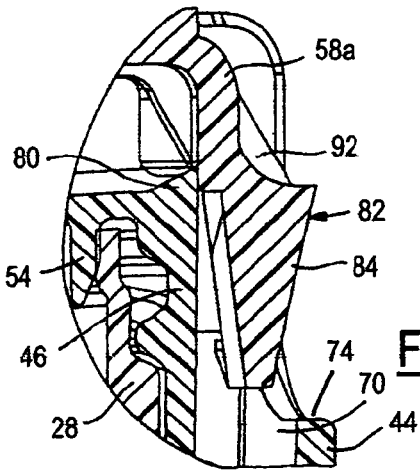

Lid 34 includes a base wall 56 having a segmented peripheral skirt 58. In the illustrated embodiment of the disclosure, lid base wall 36 is circular and skirt 58 is part-cylindrical in geometry. A pair of spaced walls 60, 62 preferably are disposed on lid base wall 56 within skirt 58 for sealing engagement within dispensing opening wall 42 on base 32, as shown in FIG. 2. In the closed position of lid 34 over base 32, the axial edge of lid skirt 58 engages a ledge 64 on base 32 that surrounds deck 38. The edge of lid skirt 58 and the surface of ledge 64 preferably are planar and perpendicular to the axis of the closure, although other skirt edge and ledge geometries can be employed. A segmented bead 66 (FIGS. 8-10) on the inside of lid skirt 58 engages a segmented external bead 68 (FIGS. 8 and 9) on base 32 to hold lid 34 by snap fit in the closed position over base 32 (FIGS. 1-7).

Figure 8:
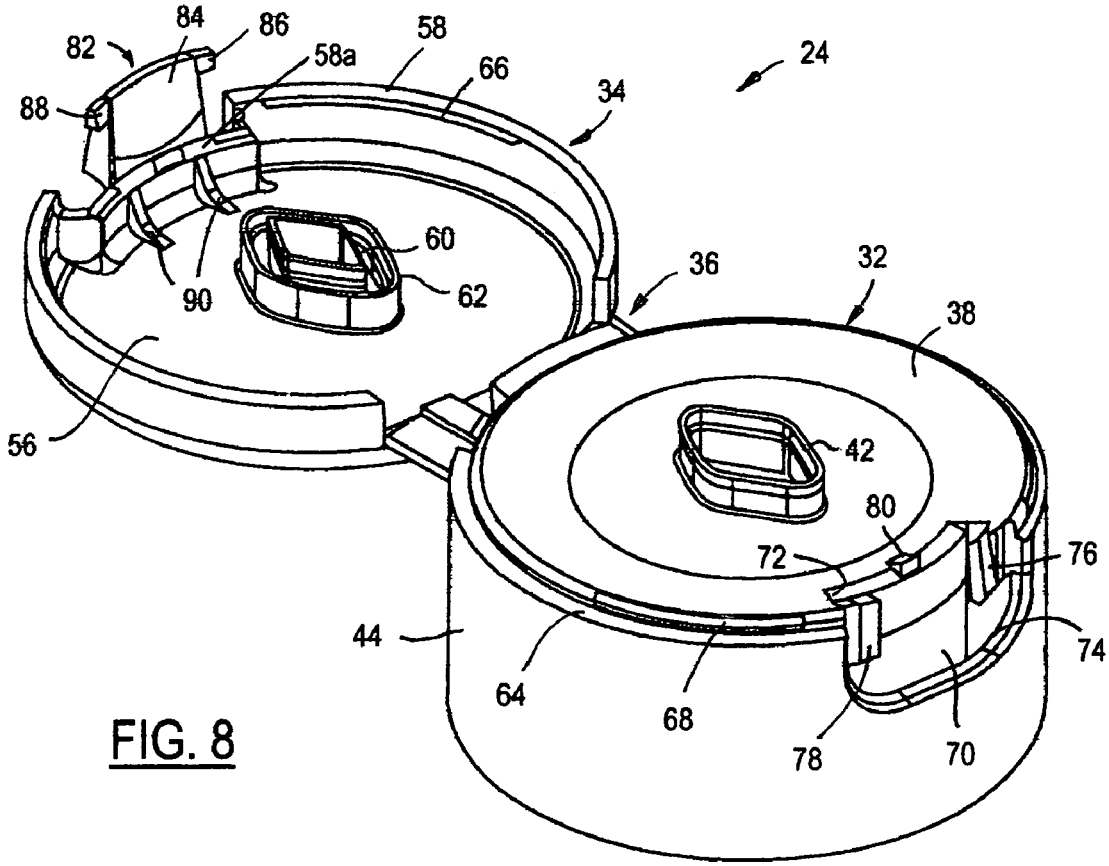
FIG. 8 is a perspective view of the closure in the package of FIGS. 1-7.
Figure 7:
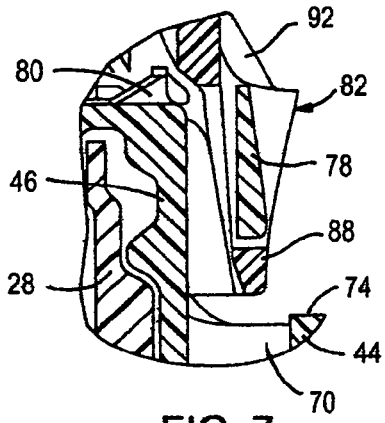
Figure 10:
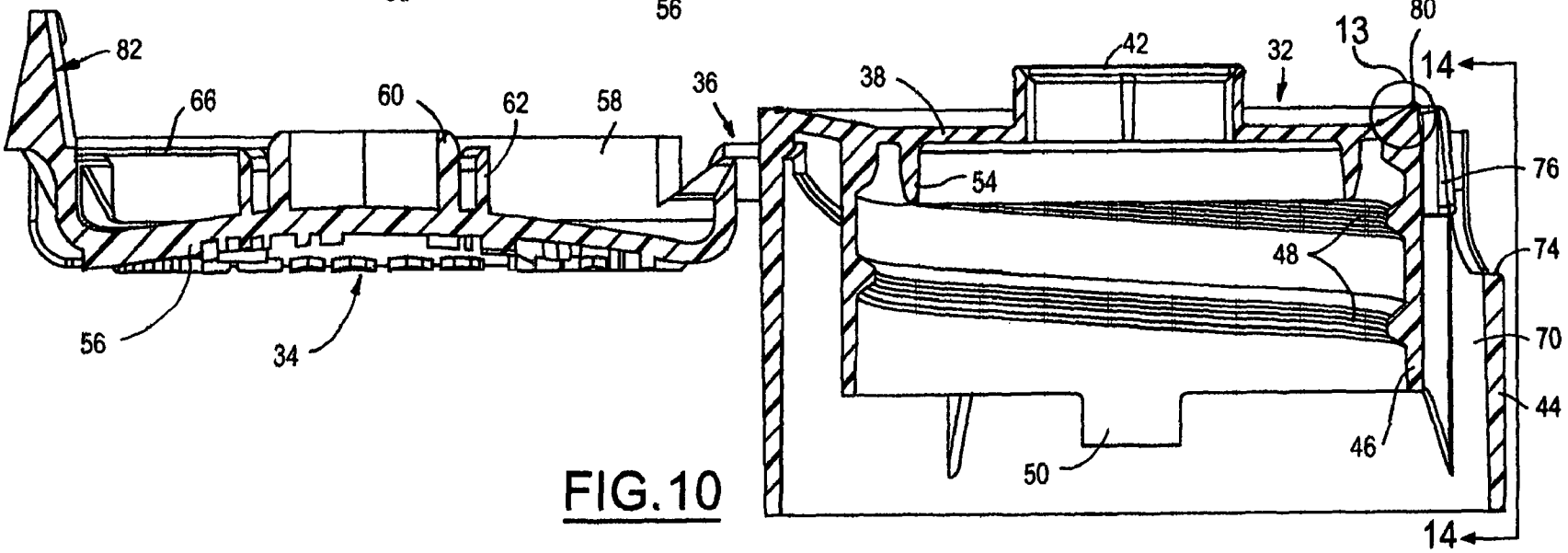
FIG. 10 is a sectional view taken substantially along the line 10-10 in FIG. 9.
Figure 11:
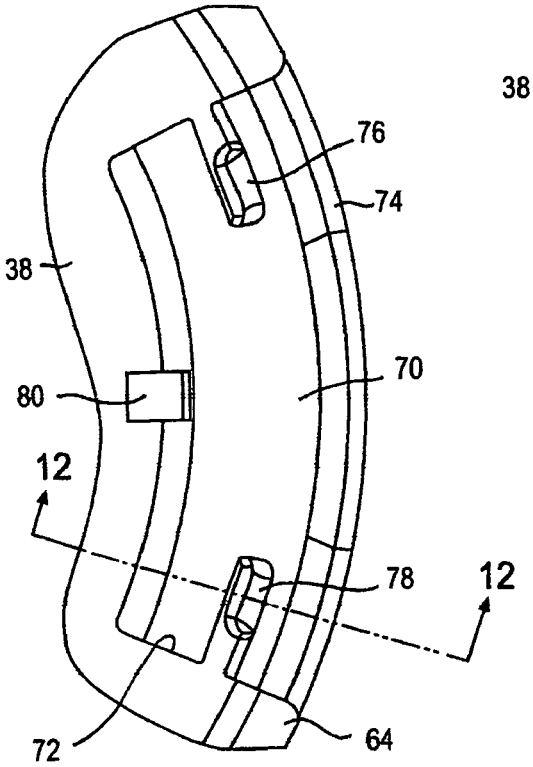
FIG. 11 is an enlargement of the portion of FIG. 9 within the area 11.
Figure 12:
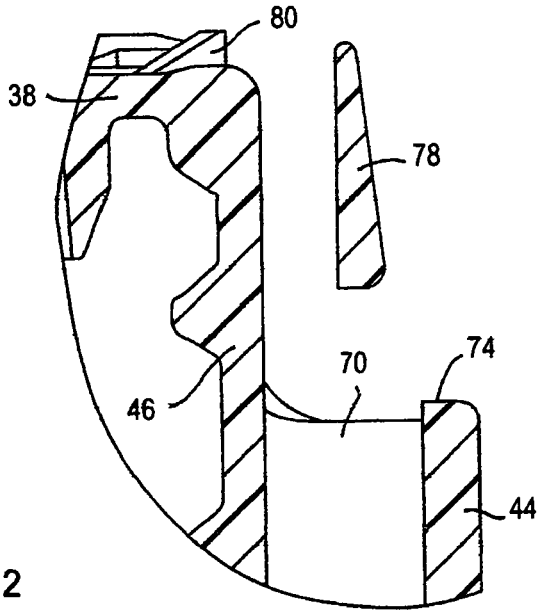
FIG. 12 is a fragmentary sectional view taken substantially along the line 12-12 in FIG. 11.
Figure 13:
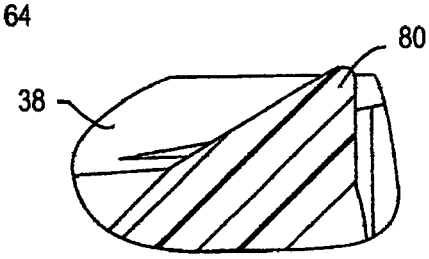
FIG. 13 is a fragmentary elevational view of the portion of FIG. 10 within the area 13.
Figure 14:
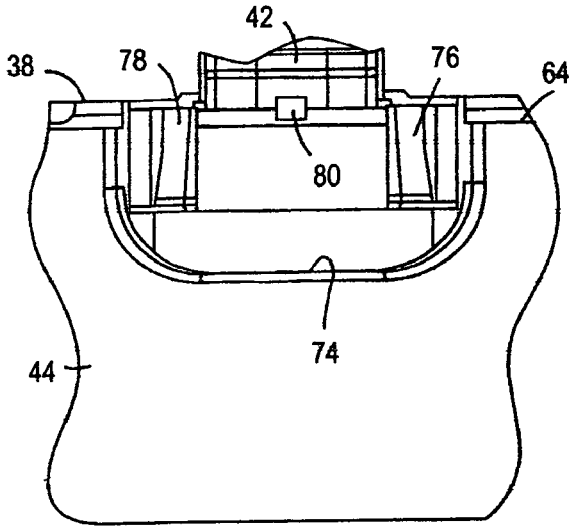
FIG. 14 is a fragmentary elevational view taken along the line 14-14 in FIG. 10.
Figure 15:
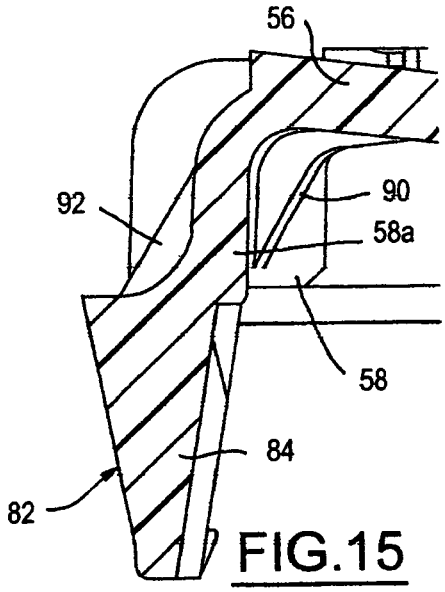
FIG. 15 is a fragmentary sectional view of the latch arm on the closure lid.

An axial passage 70 extends from an opening 72 in deck 38 between outer peripheral skirt 44 and inner wall 46 of closure base 32. Passage 70 thus is an axial passage, and is diametrically opposite from hinge 36 in closure base 32. ("Diametrically" does not mean that base 32 necessarily has to be of circular geometry as shown, but merely that axial passage 70 is disposed on the opposite side of base 32 from hinge 36. Directional words such as "axial" are employed by way of description and not limitation with respect to the central axis of base 32, which preferably although not necessarily is concentric with the central axis of dispensing opening 40, inner wall 46 and peripheral skirt 44.) There is a radial opening 74 in peripheral skirt 44 that opens to axial passage 70 adjacent to deck 38 of base 32. A pair of ledges 76, 78 extend into axial passage 70 in laterally spaced opposition to each other. Each ledge 76, 78 has a radially outwardly facing surface that extends at a downward and outward angle away from deck 38 (FIGS. 7, 8 and 10). Ledges 76, 78 also have undersurfaces that are aligned with each other across axial passage 70 (FIG. 2). A fulcrum 80 (FIGS. 2, 8 and 13), preferably in the form of a projecting triangular boss, most preferably a raised triangular boss, is disposed on deck 38 at the edge of axial passage 70 between ledges 76, 78.

Figure 9:
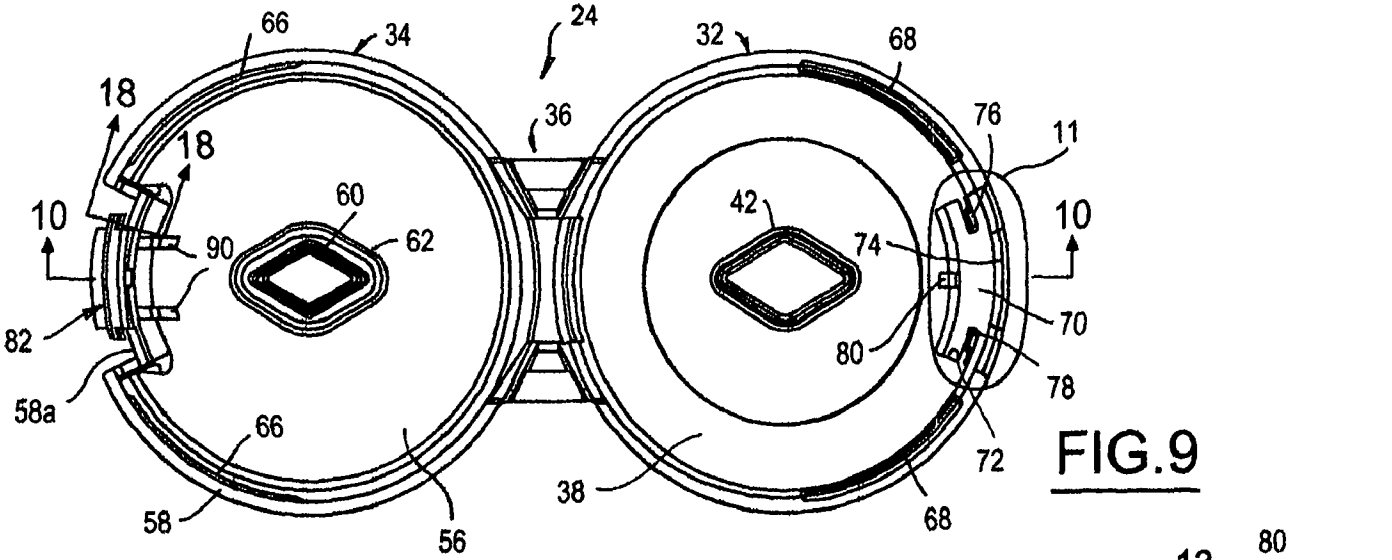
FIG. 9 is a top plan view of the closure in FIG. 8.
Figure 16:
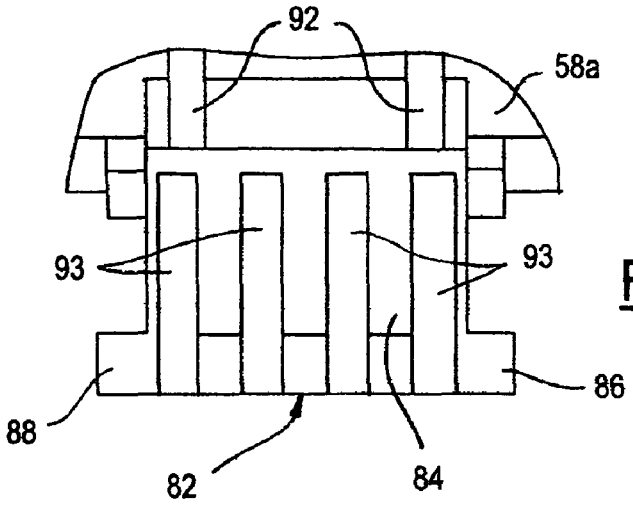
FIG. 16 is a side elevational view of the latch arm in FIG. 15.
Figure 17:
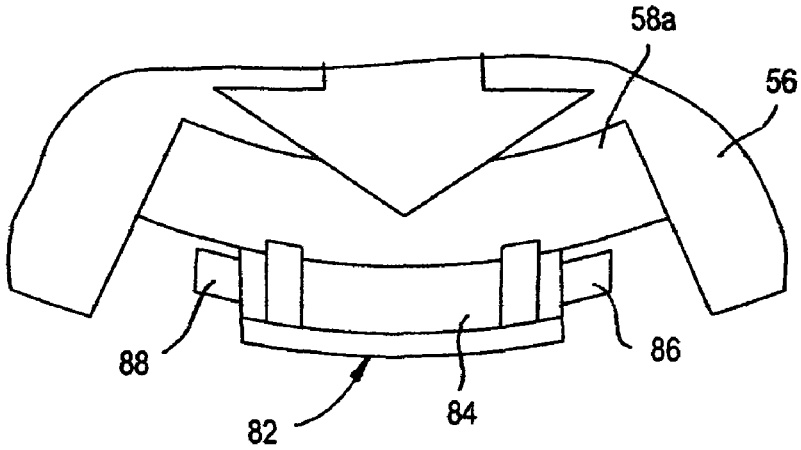
FIG. 17 is a top plan view of the latch arm.

At least one latch arm 82 extends from the edge of lid 34 at a position spaced from hinge 36, most preferably diametrically opposite from hinge 36. Latch arm 82 is generally T-shaped (FIGS. 3, 8 and 16), having a central leg 84 and a pair of laterally extending tabs 86, 88. Tabs 86, 88 preferably are adjacent to the free end of leg 84. Lid skirt 58 is indented at 58*a* (FIGS. 2, 8, 10 and 18) to accommodate latch arm 82 within the periphery of skirt 58 (FIG. 9). Skirt portion 58*a* and latch arm 82 are resiliently flexible inwardly and outwardly to open and close lid 34, as will be described. A pair of ribs 90 extend along the inner surface of skirt portion 58*a* within latch arm 82 and onto the inside surface of lid base wall 56 to strengthen skirt portion 58*a*. Latch 82 also has a pair of external ribs 92 (FIGS. 1-3, 6, 8 and 15-17) that extend from latch arm 82 to lid skirt portion 58*a* to strengthen the lid skirt. There may be a parallel array of external axial ribs 63 (FIG. 16), or raised or depressed lettering as shown in the above referenced copending application, on latch arm leg 84 to facilitate frictional engagement between the latch arm with a user's thumb.

When closing lid 34 over base 32, from the open position of FIGS. 8-17 to the closed position of FIGS. 1-7, tabs 86, 88 on latch arm 82 engage and ride along the outwardly facing cam surfaces of ledges 76, 78. The outwardly and downwardly sloping contours of ledges 76, 78 cam latch arm 82 radially outwardly as the lid is closed, so that resiliency of latch arm 82 snaps tabs 86,88 beneath ledges 76, 78 when the lid is fully closed (FIGS. 1-7). In this closed position, internal segmented bead 66 on lid 34 also engages and snaps over segmented external bead 68 on base 32 to hold the lid in the closed position. When it is desired to open the lid, the user must engage latch arm 82 through lateral opening 74 and press the latch arm radially inwardly so that tabs 86, 88 clear ledges 76, 78 within axial passage 80. Fulcrum 80 on deck 38 acts as a pivot point for such inward flexure of latch arm 82. As noted above, internal ribs 90 and external ribs 92 strengthen latch 82 so that such inward flexure of the latch can readily be accomplished by adults but is difficult to accomplish by children. Lid 38 can then be pivoted from the closed position to the open position. Internal ribs 98 on lid skirt segment 58*a* are spaced sufficiently to clear fulcrum 80 as the lid is opened. Disposition of latch arm 82 between closure skirt 44 and wall 46, accessible through opening 74, inhibits opening by biting or prying on arm 82. Opening the lid preferably requires two essentially perpendicular actions, a radially inward movement of latch arm 82 to clear ledges 76, 78 and an upward pushing on latch 82 to unsnap beads 66, 68.

Figure 18:
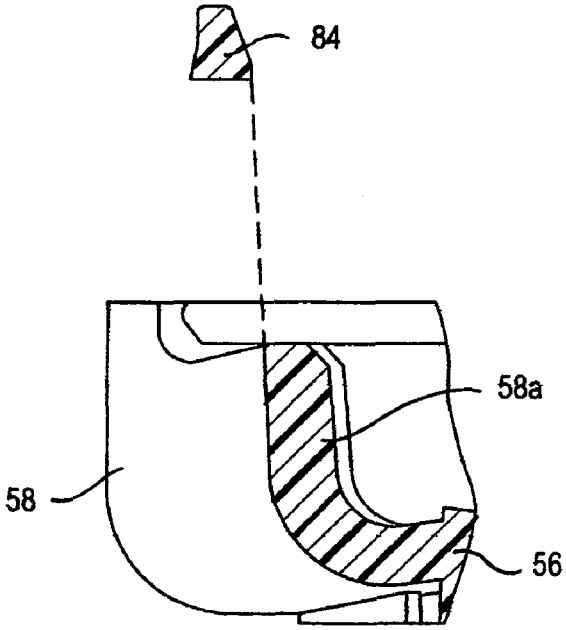
FIG. 18 is a fragmentary sectional view taken substantially along the line 18-18 in FIG. 9.

Closure 24, including base 32, hinge 36 and lid 34, preferably is formed as an integral unit of plastic construction in a suitable molding operation. As shown in FIG. 18, the inside surfaces of tabs 84, 86 preferably are aligned with the outside surface of lid skirt segment 58*a* to facilitate demolding of the closure.

There thus have been disclosed a child-resistant closure, a child-resistant package and a method of closure manufacture that fully satisfy all of the objects and aims previously set forth. The disclosure has been presented in conjunction with a presently preferred embodiment, and a number of modifications and variations have been discussed. Other modifications and variations readily will suggest themselves to persons of ordinary skill in the art in view of the foregoing disclosure. The disclosure is intended to embrace all such modifications and variations as fall within the spirit and broad scope of the appended claims.

The invention claimed is:

1. A child-resistant dispensing closure that includes:

a base having a deck with a dispensing opening, a peripheral skirt extending from said deck, an inner wall extending from said deck for securing the closure to a container, an axial passage extending from said deck between said peripheral skirt and said inner wall and opening radially through said peripheral skirt, and a pair of spaced ledges in said axial passage, and a lid molded integrally with said base and coupled by a hinge to said base so as to be pivotable between a closed position overlying said deck and an open position spaced from said deck, said lid having a latch arm resiliently extending between said inner wall and said peripheral skirt from a periphery of said lid, said latch arm having a pair of oppositely extending tabs for engagement with said ledges to lock said lid in said closed position, said latch arm being directly manually engageable by a user through said peripheral skirt opening from a radial direction external to said closure to pivot said latch arm radially inwardly within said axial passage and release said tabs from said ledges so that said lid can be pivoted toward said open position drawing said latch arm out of said axial passage.

2. The closure set forth in claim 1 in which said base has a fulcrum on said deck adjacent to said axial passage for engagement by said latch arm to increase resistance of said latch arm to bending within said axial passage.

3. A child-resistant dispensing closure that includes:

a base having a deck with a dispensing opening, a peripheral skirt extending from said deck, an inner wall extending from said deck for securing the closure to a container, an axial passage extending from said deck between said peripheral skirt and said inner wall and opening radially through said peripheral skirt, and a pair of spaced ledges in said axial passage, and a lid molded integrally with said base and coupled by a hinge to said base so as to be pivotable between a closed position overlying said deck and an open position spaced from said deck, said lid having a latch arm resiliently extending from a periphery of said lid, said latch arm having a pair of oppositely extending tabs for engagement with said ledges to lock said lid in said closed position, said latch arm being directly manually engageable by a user from a radial direction external to said closure to pivot said latch arm radially inwardly within said axial passage and release said tabs from said ledges so that said lid can be pivoted toward said open position drawing said latch arm out of said axial passage, wherein said base has a fulcrum on said deck adjacent to said axial passage for engagement by said latch arm to increase resistance of said latch arm to bending within said axial passage, and wherein said fulcrum is projecting from said deck adjacent to said axial passage.

4. The closure set forth in claim 3 wherein said latch arm includes reinforcing ribs spaced from each other for passage past said fulcrum.

5. The closure set forth in claim 1 wherein said tabs have inside surfaces aligned with an outside surface of said lid adjacent to said latch arm in the open position of said lid to facilitate demolding of said closure.

6. The closure set forth in claim 1 including at least one tab extending from said inner wall for engagement with at least one lug on a container finish to inhibit removal of said closure from the container finish.

7. A child-resistant dispensing closure that includes:

a base having a deck with a dispensing opening, a peripheral skirt extending from said deck, a cylindrical inner wall extending from said deck concentrically with said peripheral skirt for securing the closure to a container, an axial passage extending from said deck between said peripheral skirt and said inner wall and opening radially outwardly through said peripheral skirt, and a pair of ledges spaced from each other on opposed sides of said passage, and a lid integrally molded with said base and coupled by a hinge to said base so as to be pivotable between a closed position overlying said deck and an open position spaced from said deck, said lid having a latch arm resiliently extending between said inner wall and said peripheral skirt from a periphery of said lid, said latch arm being T-shaped having a center leg coupled to said lid and a pair of tabs extending laterally oppositely from said leg for engagement with said ledges to lock said lid in said closed position, said latch arm being manually engageable by a user through said peripheral skirt opening from a radial direction external to said closure to pivot said latch arm radially inwardly within said axial passage and release said tabs from said ledges so that said lid can be pivoted toward said open position drawing said latch arm out of said passage.

8. The closure set forth in claim 7 wherein said ledges have radially outwardly facing surfaces that said latch arm engages as said lid is moved toward said closed position such that said tabs on said latch arm snap radially inwardly beneath said ledges due to resilience of said latch arm and connection between said latch arm and said lid.

9. The closure set forth in claim 8 wherein said radially outwardly facing surfaces on said ledges are angulated cam surfaces.

10. A child-resistant dispensing closure that includes:

a base having a deck with a dispensing opening, a peripheral skirt extending from said deck, a cylindrical inner wall extending from said deck concentrically with said peripheral skirt for securing the closure to a container, an axial passage extending from said deck between said peripheral skirt and said inner wall and opening radially outwardly through said peripheral skirt, and a pair of ledges spaced from each other on opposed sides of said passage, and a lid integrally molded with said base and coupled by a hinge to said base so as to be pivotable between a closed position overlying said deck and an open position spaced from said deck, said lid having a latch arm resiliently extending from a periphery of said lid, said latch arm being T-shaped having a center leg coupled to said lid and a pair of tabs extending laterally oppositely from said leg for engagement with said ledges to lock said lid in said closed position, said latch arm being manually engageable by a user from a radial direction external to said closure to pivot said latch arm radially inwardly within said axial passage and release said tabs from said ledges so that said lid can be pivoted toward said open position drawing said latch arm out of said passage, wherein said base has a fulcrum on said deck adjacent to said axial passage for engagement by said latch arm to increase resistance of said latch arm to bending within said axial passage.

11. The disclosure set forth in claim 7 wherein said tabs have inside surfaces aligned with an outside surface of said lid adjacent to said latch arm in the open position of said lid to facilitate demolding of said closure.

12. A child-resistant package that includes:

a container having a neck finish and a child-resistant dispensing closure secured to said neck finish, said closure including:

a base having a deck with a dispensing opening, a peripheral skirt extending from said deck, an inner wall extending from said deck for securing the closure to a container, an axial passage extending from said deck between said peripheral skirt and said inner wall and opening radially through said peripheral skirt, and a pair of spaced ledges in said axial passage, and a lid molded integrally with said base and coupled by a hinge to said base so as to be pivotable between a closed position overlying said deck and an open position spaced from said deck, said lid having a latch arm resiliently extending between said inner wall and said peripheral skirt from a periphery of said lid opposite said hinge, said latch arm having a pair of oppositely extending tabs for engagement with said ledges to lock said lid in said closed position, said latch arm being directly manually engageable by a user through said peripheral skirt opening from a radial direction external to said closure to pivot said latch arm radially inwardly within said axial passage and release said tabs from said ledges so that said lid can be pivoted toward said open position drawing said latch arm out of said axial passage.

13. The package set forth in claim 12 in which said base has a fulcrum on said deck adjacent to said axial passage for engagement by said latch arm to increase resistance of said latch arm to bending within said axial passage.

14. A child-resistant package that includes:

a container having a neck finish and a child-resistant dispensing closure secured to said neck finish, said closure including:

a base having a deck with a dispensing opening, a peripheral skirt extending from said deck, an inner wall extending from said deck for securing the closure to a container, an axial passage extending from said deck between said peripheral skirt and said inner wall and opening radially through said peripheral skirt, and a pair of spaced ledges in said axial passage, and a lid molded integrally with said base and coupled by a hinge to said base so as to be pivotable between a closed position overlying said deck and an open position spaced from said deck, said lid having a latch arm resiliently extending from a periphery of said lid opposite said hinge, said latch arm having a pair of oppositely extending tabs for engagement with said ledges to lock said lid in said closed position, said latch arm being directly manually engageable by a user from a radial direction external to said closure to pivot said latch arm radially inwardly within said axial passage and release said tabs from said ledges so that said lid can be pivoted toward said open position drawing said latch arm out of said axial passage, wherein said base has a fulcrum on said deck adjacent to said axial passage for engagement by said latch arm to increase resistance of said latch arm to bending within said axial passage, and wherein said fulcrum is projecting from said deck adjacent to said axial passage.

15. The package set forth in claim 14 wherein said latch arm includes reinforcing ribs spaced from each other for passage past said fulcrum.

16. The package set forth in claim 12 wherein said tabs have inside surfaces aligned with an outside surface of said lid adjacent to said latch arm in the open position of said lid to facilitate demolding of said closure.

17. The package set forth in claim 12 including at least one tab extending from said inner wall for engagement with at least one lug on a container finish to inhibit removal of said closure from the container finish.

* * * * *